US010081092B2

(12) United States Patent
Lazarov

(10) Patent No.: US 10,081,092 B2
(45) Date of Patent: Sep. 25, 2018

(54) IRRIGATION BOLT WRENCH COMBINATION

(71) Applicant: Ross Lazarov, Prior Lake, MN (US)

(72) Inventor: Ross Lazarov, Prior Lake, MN (US)

( * ) Notice: Subject to any disclaimer, the term of this patent is extended or adjusted under 35 U.S.C. 154(b) by 161 days.

(21) Appl. No.: 15/292,380

(22) Filed: Oct. 13, 2016

(65) Prior Publication Data

US 2017/0028532 A1 Feb. 2, 2017

Related U.S. Application Data

(63) Continuation-in-part of application No. 14/304,164, filed on Jun. 13, 2014, now Pat. No. 9,475,177.

(51) Int. Cl.

| | |
|---|---|
| ***B25B 7/02*** | (2006.01) |
| ***B25B 7/10*** | (2006.01) |
| ***B25F 1/00*** | (2006.01) |

(52) U.S. Cl.

CPC ..... *B25B 7/02* (2013.01); *B25B 7/10* (2013.01); *B25F 1/003* (2013.01)

(58) Field of Classification Search

CPC ..... B25B 7/02; B25B 7/10; B25F 1/003
See application file for complete search history.

(56) References Cited

U.S. PATENT DOCUMENTS

| | | | | |
|---|---|---|---|---|
| 3,940,066 | A | 2/1976 | Hunter | |
| 4,028,971 | A | 6/1977 | Budrose | |
| 4,738,167 | A | 4/1988 | Ball | |
| 4,870,876 | A | 10/1989 | Rodriguez | |
| 4,934,222 | A | 6/1990 | Rittmann et al. | |
| 5,062,173 | A | 11/1991 | Collins et al. | |
| 5,595,094 | A | 1/1997 | Negus | |
| 6,081,952 | A | 7/2000 | Haxton | |
| 6,322,363 | B1 | 11/2001 | Beecher et al. | |
| 6,327,943 | B1 | 12/2001 | Wrigley et al. | |
| 6,880,434 | B2 | 4/2005 | Nouvel | |
| 6,918,324 | B2 | 7/2005 | Hsein | |
| 7,040,201 | B2 | 5/2006 | Engvall et al. | |
| 7,156,004 | B1 | 1/2007 | Whitehead et al. | |
| 7,313,989 | B1 | 1/2008 | Tortolani, Jr. | |
| 7,735,399 | B2 | 7/2010 | Robinson et al. | |
| 7,975,577 | B2 | 7/2011 | Pfab | |
| 7,997,170 | B1 | 8/2011 | Martinez et al. | |
| 8,272,300 | B2 | 9/2012 | Fournier | |
| 8,479,399 | B2 | 7/2013 | Putsch | |
| 8,661,948 | B2 * | 3/2014 | DeBaker | B21K 5/00 81/405 |
| 8,925,364 | B2 * | 1/2015 | Gupta | A44C 27/00 29/267 |
| 9,120,207 | B2 * | 9/2015 | Chang | B25B 7/02 |
| 9,475,177 | B1 * | 10/2016 | Lazarov | B25B 7/10 |
| 9,636,804 | B2 * | 5/2017 | Wu | B25B 7/02 |
| 2011/0167612 | A1 * | 7/2011 | Marshall | B25B 7/00 29/428 |
| 2015/0240519 | A1 * | 8/2015 | Johnstone | B25B 7/02 7/117 |
| 2015/0303638 | A1 * | 10/2015 | Collie | H01R 43/22 81/420 |

* cited by examiner

*Primary Examiner* — David B Thomas
(74) *Attorney, Agent, or Firm* — Haugen Law Firm PLLP

(57) ABSTRACT

An irrigation tool is described that may be used to unloosen a sprinkler head of an underground water irrigation system without the need to expose the entire sprinkler head assembly. The device allows for sufficient torque to be applied to the sprinkler head without the need for a wide unobstructed wrench turning radius about the sprinkler head.

19 Claims, 21 Drawing Sheets

IRRIGATION BOLT WRENCH COMBINATION

CROSS-REFERENCE TO RELATED APPLICATIONS

This application claims the filing benefit and priority of U.S. patent application Ser. No. 14/304,164 filed on 13 Jun. 2014, the contents of which are incorporated herein by reference in its entirety.

FEDERAL SPONSORSHIP

Not Applicable

JOINT RESEARCH AGREEMENT

Not Applicable

TECHNICAL FIELD

This invention pertains generally to irrigation tools used to tighten and loosen the cap of a sprinkler head of an irrigation system. More particularly, the invention pertains to an irrigation tool that reduces the need to remove large amounts of terrain surrounding the sprinkler head cap when replacing a riser of the sprinkler head assembly.

BACKGROUND

Over the years various underground irrigation systems have been devised for both residential and commercial settings to irrigate the surrounding landscape. These irrigation systems typically include a multitude of sprinkler head assemblies coupled to underground irrigation water conduits. A portion of each sprinkler head assembly actuates between a lowered and stored position to an elevated and spraying position when a water pressure is applied through the sprinkler head assembly. Typically, a sprinkler head assembly includes a body or base that is fixed to the irrigation conduit. A cap threads onto the body and the cap restricts a riser and sprinkler nozzle within the body that actuates up and down. The base and cap are buried below the surface of the landscape.

From time to time the sprinkler riser may require replacement. To remove the riser, grass or other terrain surrounding the sprinkler body must be removed to expose the cap secured to the body. The amount of terrain surrounding the cap of the sprinkler body that must be removed is dependent upon the amount of unrestricted free space required to turn a tool used to unloosen the cap. Tools available for loosening the cap typically require a large turning radius and, thus, a large amount of terrain surrounding the sprinkler assembly must be removed to allow a turning of the tool. A smaller turn radius would require the removal of less terrain but would also limit the length of the tool that could be used. Oftentimes, a longer handled tool and greater turn radius is required to provide sufficient torque to unloosen the cap. Also, tools having multiple functions are required to replace a sprinkler riser. A single tool capable of performing the multiple functions may reduce cost and increase efficiency.

SUMMARY

Embodiments according to aspects of the invention provide an irrigation multi-function wrench combination that requires a smaller turning radius while still providing sufficient torque to unloosen the cap of a sprinkler head assembly.

In accordance with aspects of the invention, an embodiment of the invention includes a first handle, second handle, a pivot member having first and second tool members extending from the pivot member, and gripping jaw members extending from an end of each handle. Extending from the bottom of the gripping jaw members are lugs. The lugs align and engage with features such as ribs or flutes on the sides of a sprinkler head assembly cap. The pivot interconnects the first handle and second handle so that a gripping jaw member of each handle is aligned in an opposing relation to the other gripping jaw member. The handles rotate about the pivot to increase or decrease a separation distance between the gripping jaw members. The first tool member extends from the pivot, wherein the first tool member has a flattened tip portion. The second tool member extends from the pivot, wherein the second tool member has a keyed tip portion.

Additionally, the gripping jaw members have a top surface, bottom surface and opposing inner and outer side surfaces. Gripping teeth are formed on the inner side surface of each gripping jaw member. The inner surface may have a continuous curve or alternatively may include a v-shaped geometry to provide better gripping of various sized and diameter objects. The teeth may be formed continuous along the inner surface or may include groups or sets of teeth with space in between the sets. By way of example, first and second teeth sets are formed on the inner side surface of each gripping jaw member, with each teeth set having a plurality of teeth. Each tooth has a flat chisel like front edge and an angling away back edge. In an embodiment of the invention a first teeth set has the flat chisel like front edge facing towards the handle and a second teeth set having the flat chisel like front edge facing away from the handle. Alternatively, the direction each teeth set faces may be modified to provide different gripping characteristics when unloosening and tightening with the tool. For example, both teeth sets may face the same direction or may be staggered in opposing directions within the gripping jaws to provide a chisel grip when rotating the tool in either direction.

The first and second opposed gripping jaw members together have a gripping jaw longitudinal axis. Similarly, a portion of the handles near or adjacent the gripping jaw members have a handle longitudinal axis. The gripping jaw longitudinal axis is not parallel with the handle longitudinal axis but intersects the handle longitudinal axis at an obtuse angle of more than 90 degrees and less than 180 degrees. Also, in an embodiment of the invention, the gripping jaw longitudinal axis is not coplanar with at least a portion of the first and second handle.

The accompanying drawings, which are incorporated in and constitute a portion of this specification, illustrate embodiments of the invention and, together with the detailed description, serve to further explain the invention. The embodiments illustrated herein are presently preferred; however, it should be understood, that the invention is not limited to the precise arrangements and instrumentalities shown. For a fuller understanding of the nature and advantages of the invention, reference should be made to the detailed description in conjunction with the accompanying drawings.

DESCRIPTION OF THE DRAWINGS

In the various figures, which are not necessarily drawn to scale, like numerals throughout the figures identify substantially similar components.

DETAILED DESCRIPTION

Figure 1:
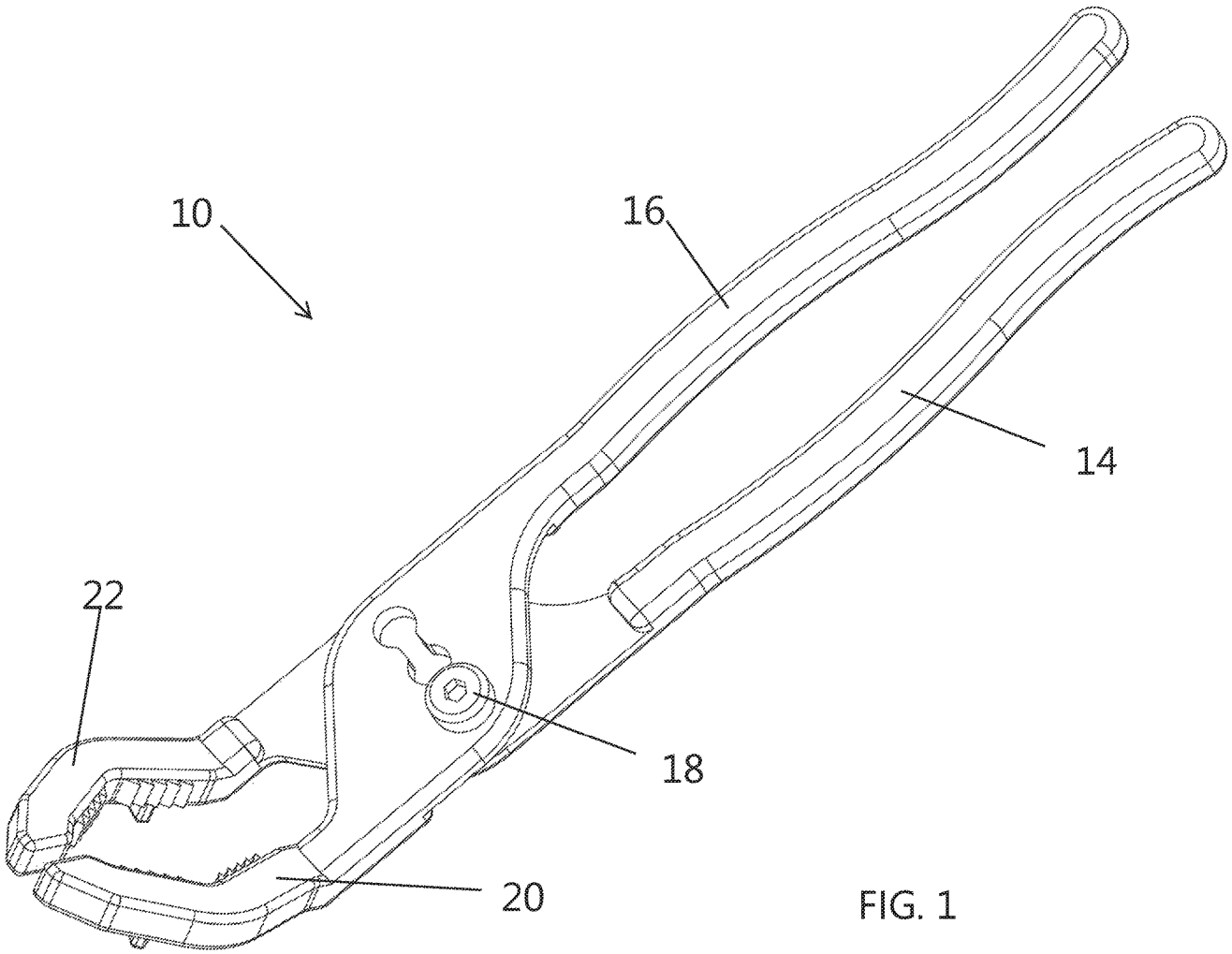
FIG. 1 is a front left perspective view of an irrigation wrench in accordance with an embodiment of the invention.
Figure 2:
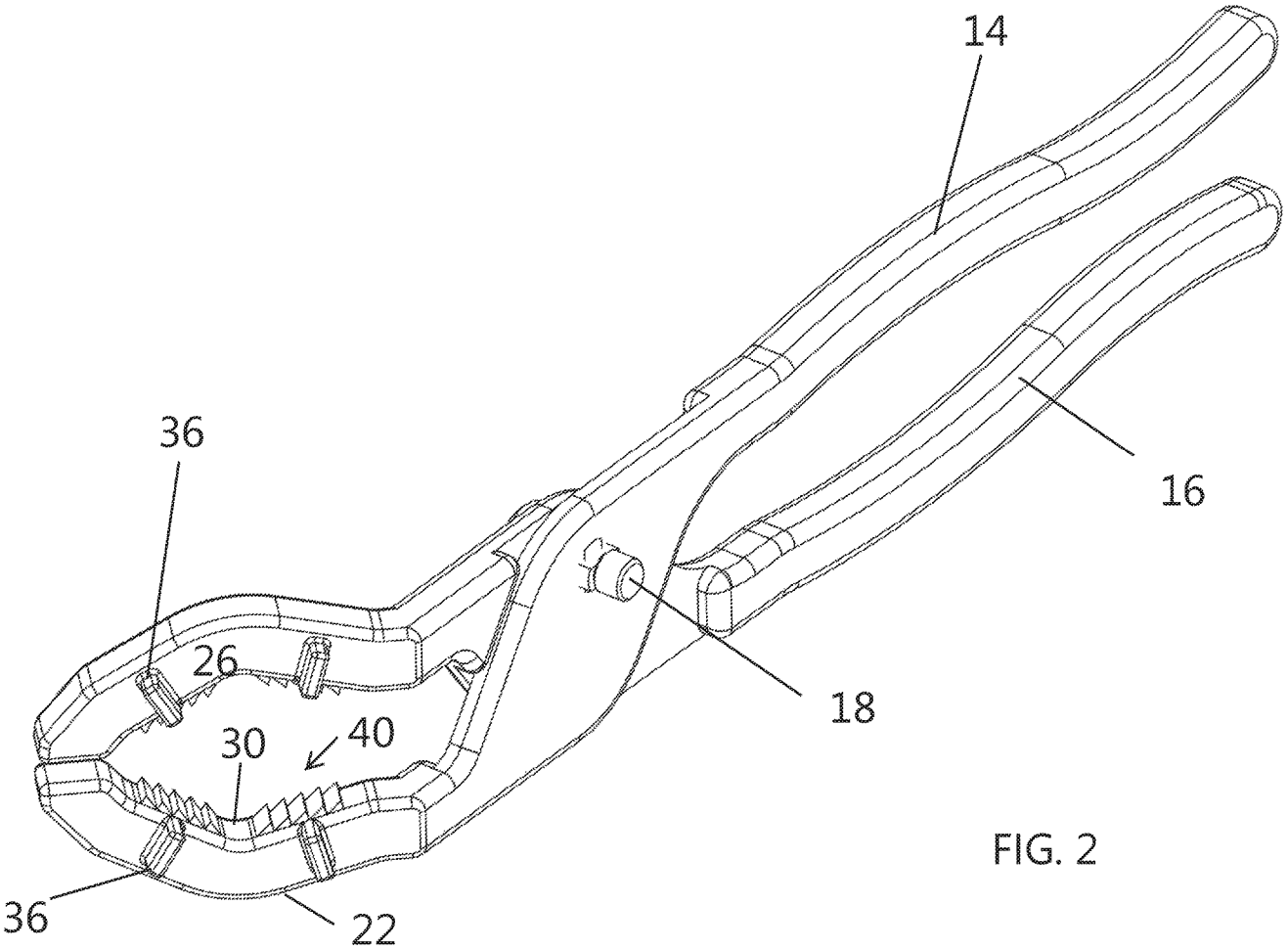
FIG. 2 is a bottom perspective view of the irrigation wrench of the type shown in FIG. 1.
Figure 3:
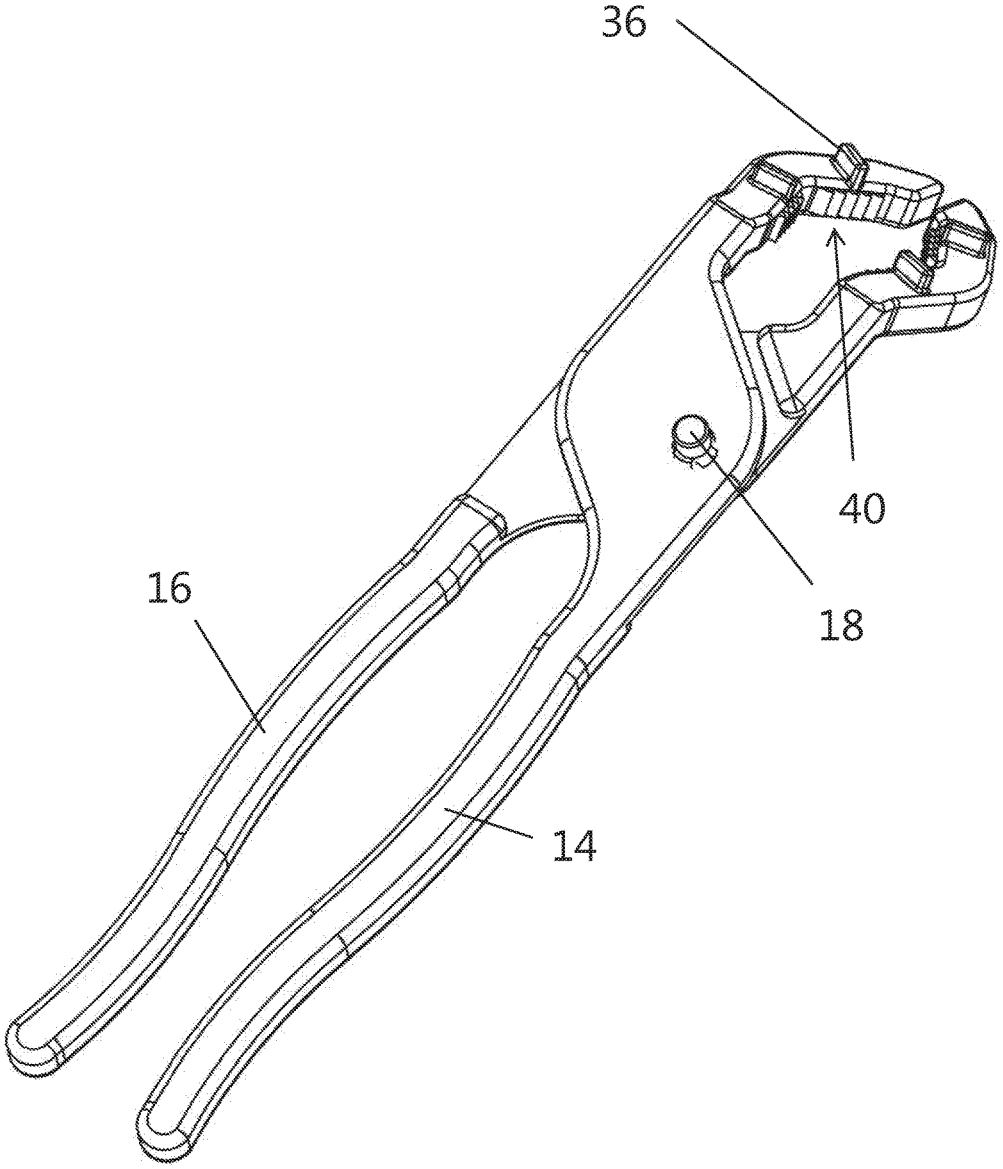
FIG. 3 is a top right perspective view of the irrigation wrench of the type shown in FIG. 1.

The following description provides detail of various embodiments of the invention, one or more examples of which are set forth below. Each of these embodiments are provided by way of explanation of the invention, and not intended to be a limitation of the invention. Further, those skilled in the art will appreciate that various modifications and variations may be made in the present invention without departing from the scope or spirit of the invention. By way of example, those skilled in the art will recognize that features illustrated or described as part of one embodiment, may be used in another embodiment to yield a still further embodiment. Thus, it is intended that the present invention also cover such modifications and variations that come within the scope of the appended claims and their equivalents.

An irrigation tool 10 particularly well suited as a sprinkler head wrench generally includes handles 14 and 16, griping jaw members 20 and 22, pivot 18, lugs 36 and teeth 40. The handles extend from the gripping jaw members at an angle such that the top plan surface of the handles is not in the same plane as the top plan surface of the gripping jaw members. In use, the teeth and lugs grip the cap, allowing the user to apply a torque to the cap to either loosen or tighten the cap. The handles extend from the gripping jaw members at an angle sufficient to significantly reduce the turning radius of turn while at the same time the lugs keep the tool aligned on the cap to provide a required torque to loosen or tighten the cap of the sprinkler assembly.

With reference to the figures and in particular with reference to FIGS. 1-4, an irrigation wrench or tool 10 is generally illustrated having two handles 14 and 16 and two gripping jaw members 20 and 22. Lugs 36 extending from a bottom plan surface of the jaw gripping members engage a side of a cap of a sprinkler head assembly. A pivot 18 interconnects the handles 14 and 16 in a rotational relation. The pivot includes an adjustable pivot slot 68 that allows the separation distance between the two gripping jaw members to be increased and decreased as desired to best match the diameter of the object to be gripped. The angled handles reduce the required turning radius of the tool.

Figure 4:
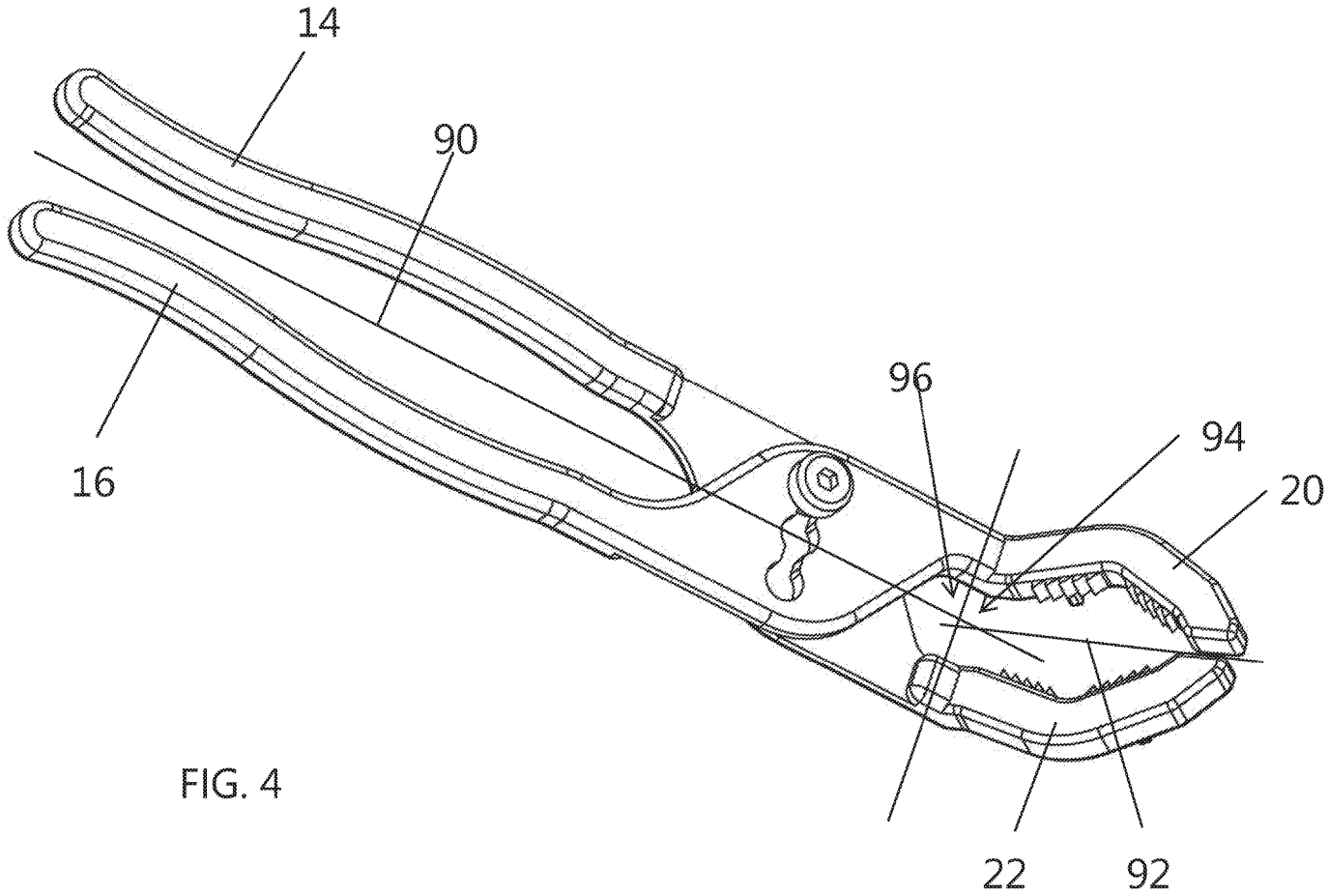
FIG. 4 is a bottom left perspective view of the irrigation wrench of the type shown in FIG. 1.

As shown in FIG. 4, the handles together have a longitudinal axis 90 and the jaw members together have a longitudinal axis 92. The longitudinal axis of the handle and the longitudinal axis of the jaw members intersect at an angle less than 180 degrees but greater than 90 degrees. Without limitation intended, the preferred angle approximates 135 degrees. By angling the handles away from the jaw member's longitudinal axis, a required turning radius is reduced. The embodiment illustrated in FIG. 4 depicts the longitudinal axis of the handles coplanar with the longitudinal axis of the jaw members.

Figure 5:
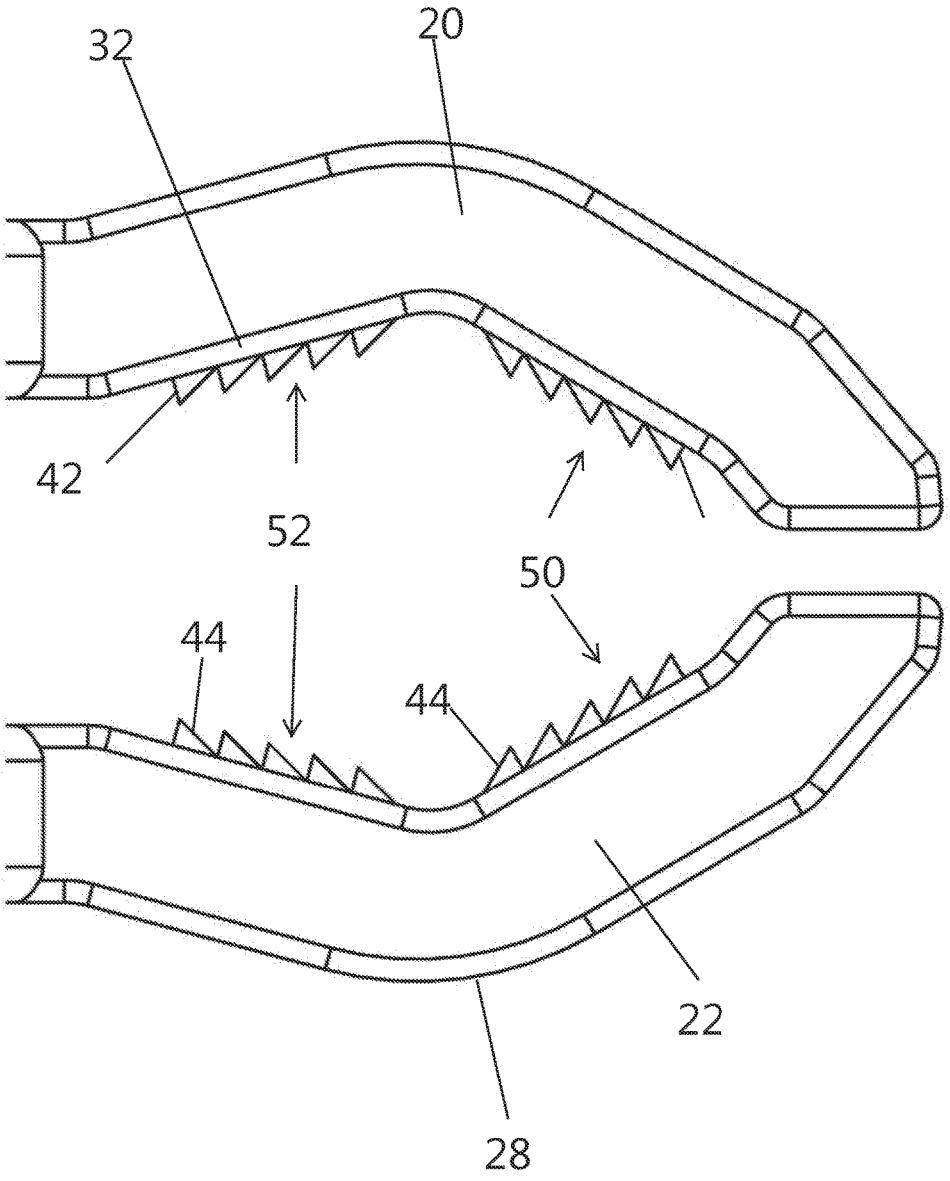
FIG. 5 is an enlarged partial sectioned top view of the gripping jaw members of the irrigation wrench of the type shown in FIG. 1.
Figure 6:
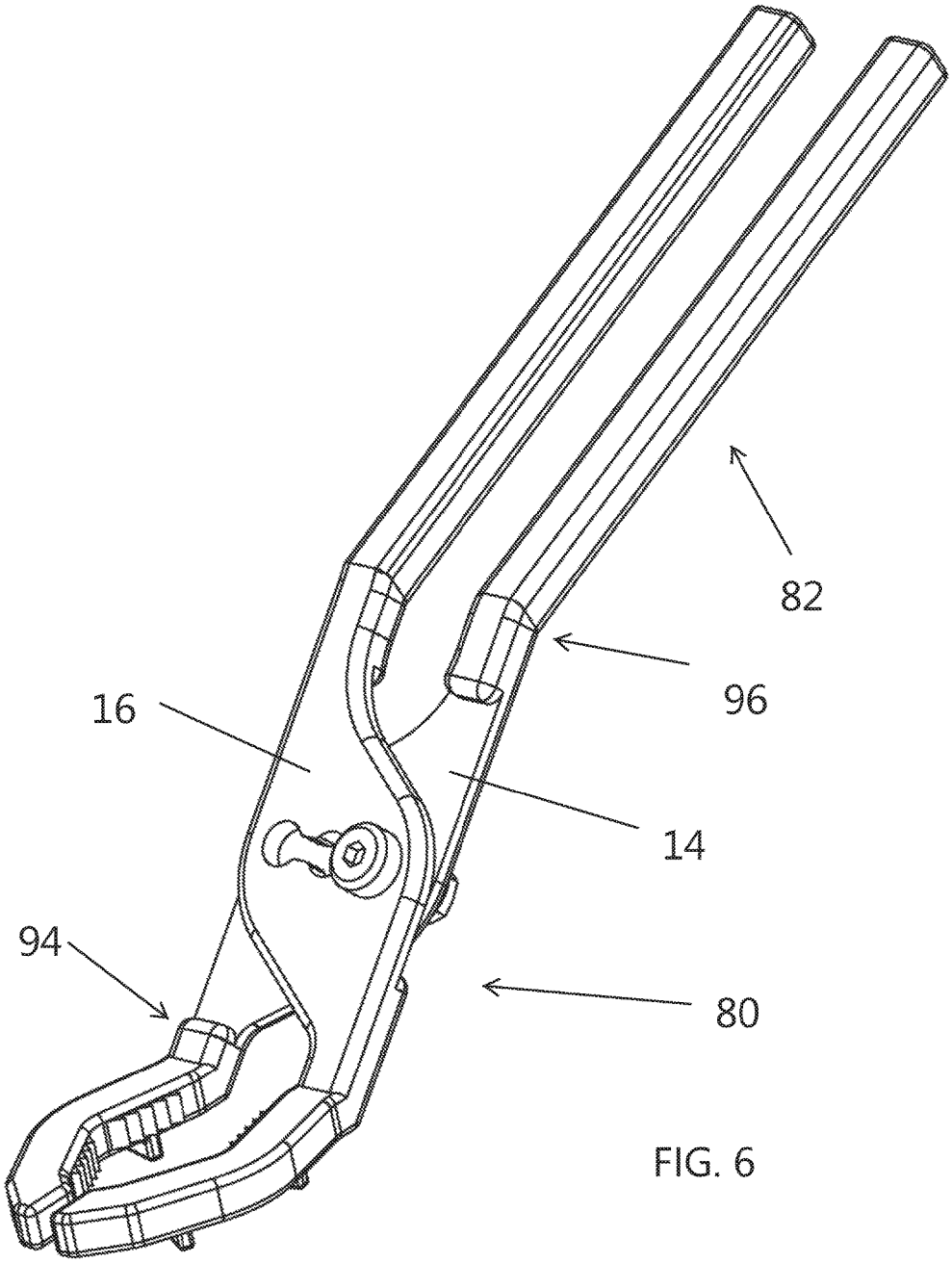
FIG. 6 is a left perspective view of an irrigation wrench in accordance with an embodiment of the invention.
Figure 7:
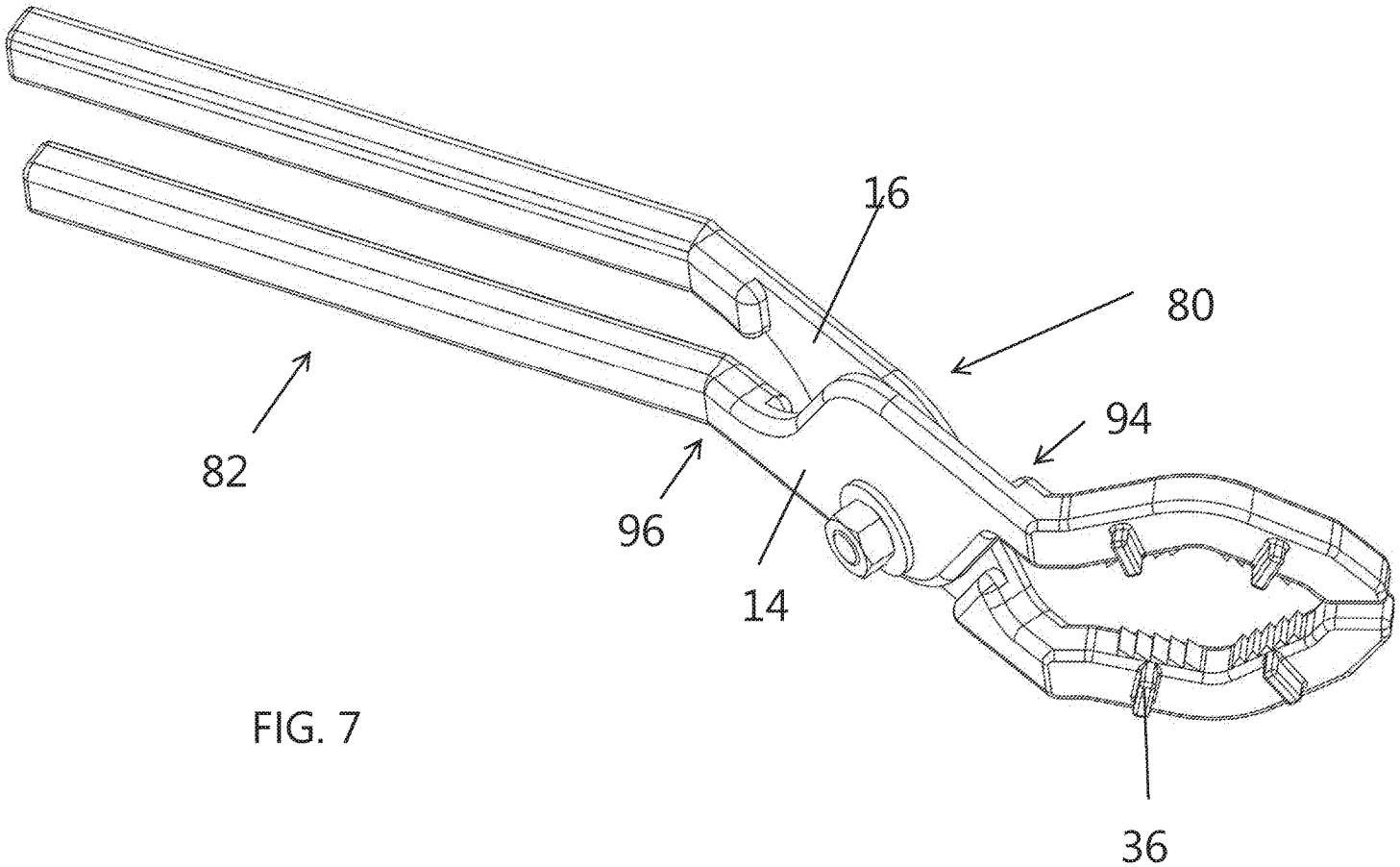
FIG. 7 is a bottom perspective view of the irrigation wrench of the type shown in FIG. 6.
Figure 8:
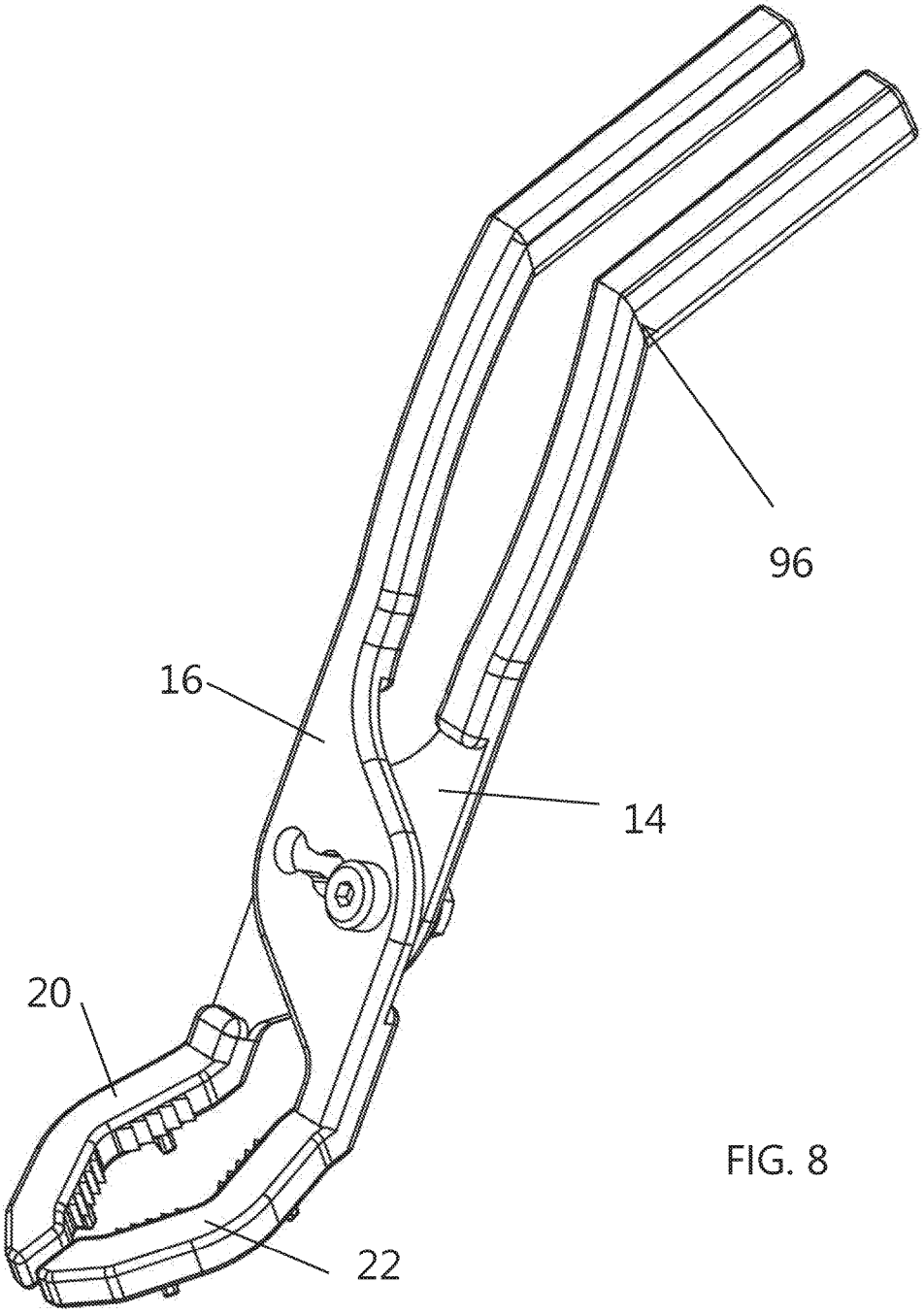
FIG. 8 is a left perspective view of an irrigation wrench in accordance with an embodiment of the invention.
Figure 9:
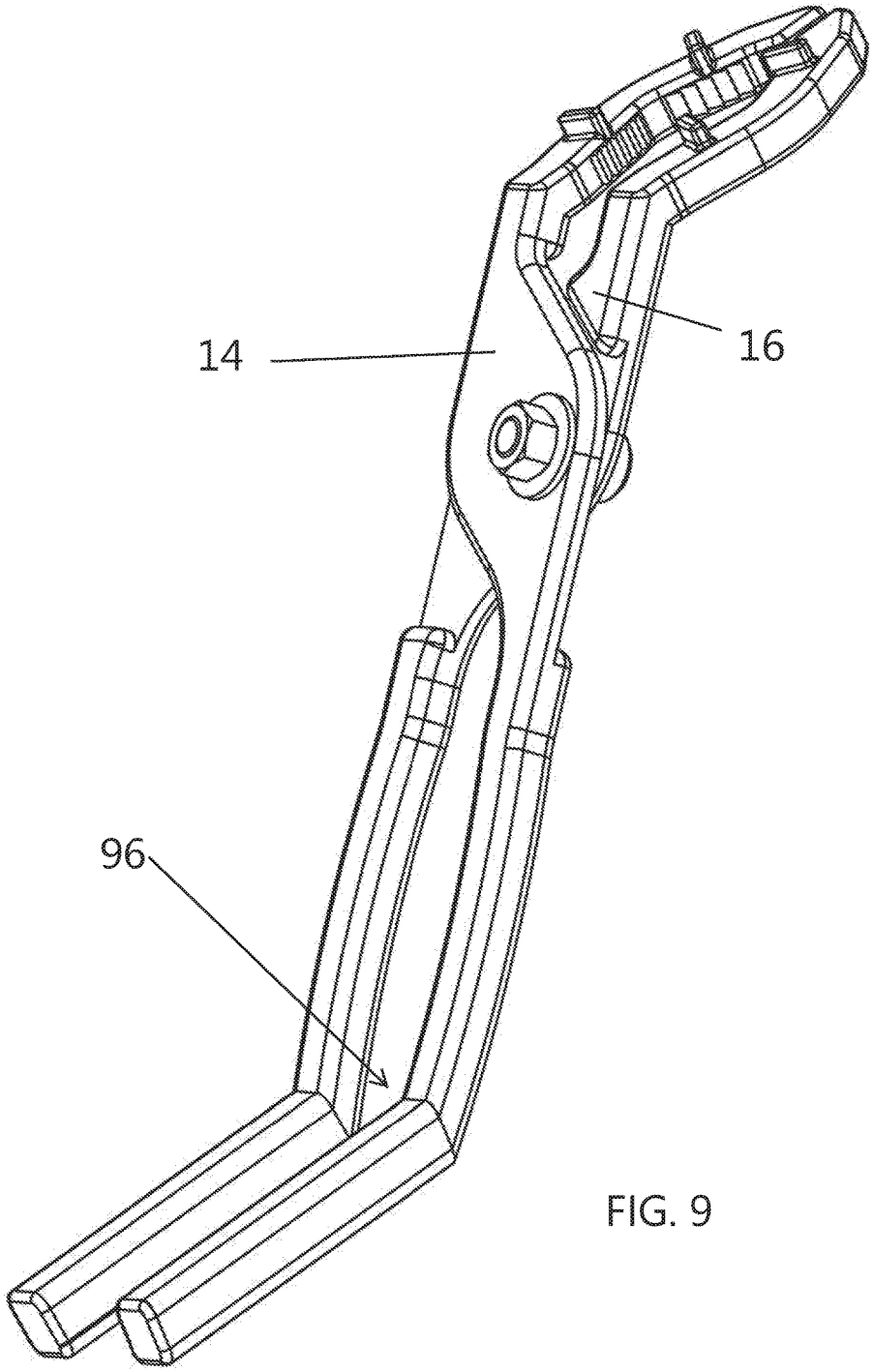
FIG. 9 is a back left perspective view of an irrigation wrench in accordance with an embodiment of the invention.

With reference to FIG. 5 each gripping jaw member 20 and 22 has an outer side 28 and inner side 30. The inner side 30 includes an inner profile 32 that may be optimized to increase the amount of surface area of the teeth that contacts the surface of the object to be gripped. For example, a shallow v-shaped inner profile optimizes the number of teeth that contact the cap of the sprinkler head assembly. The profile of each jaw member may include at least a front set of teeth 50 and a back set of teeth 52. The orientation of the two sets of teeth may be modified to further engage the object. Each tooth includes a chisel face front 42 and a slopping back 44. At least one set of teeth on each jaw gripping member 20 and 22 faces towards the corresponding handle. In this manner at least one set of chisel face front teeth bite into the object as the handles are turned, regardless the direction of rotation.

In other embodiments of the invention illustrated in FIGS. 6-9, at least a first or second portion 80 and 82 of the handles 14 and 16 may be further offset at an angle 96 from the jaw members 20 and 22 such that the longitudinal axis 90 of the handles are neither parallel nor coplanar with the longitudinal axis 92 of the jaw members. An angle of offset 96 less than 180 degrees increases the torque transferred from the handles to the jaw members when rotated in one direction but an amount of transferred torque is reduced when the handles are turned in the opposite direction.

Figure 10:
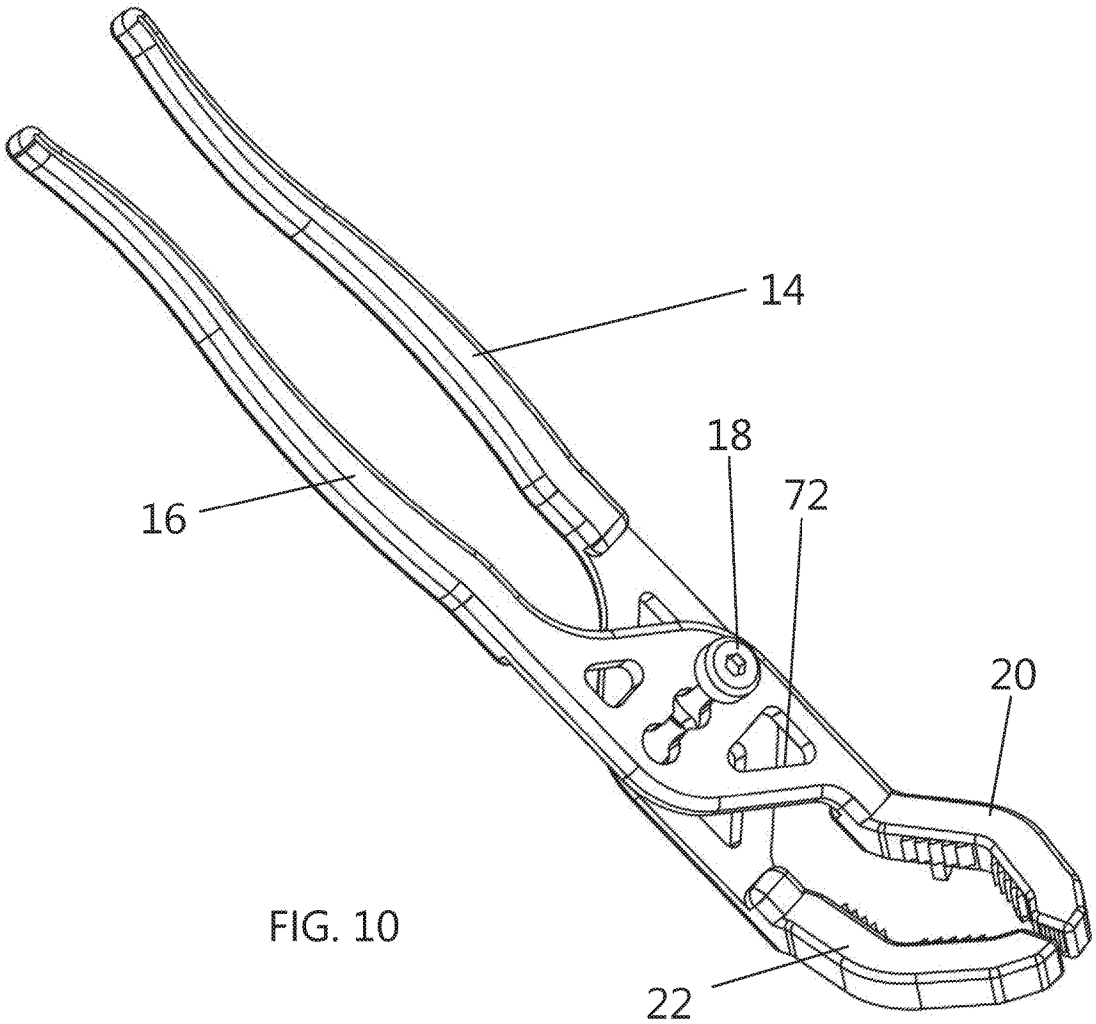
FIG. 10 is a right perspective view of an irrigation wrench in accordance with an embodiment of the invention.
Figure 11:
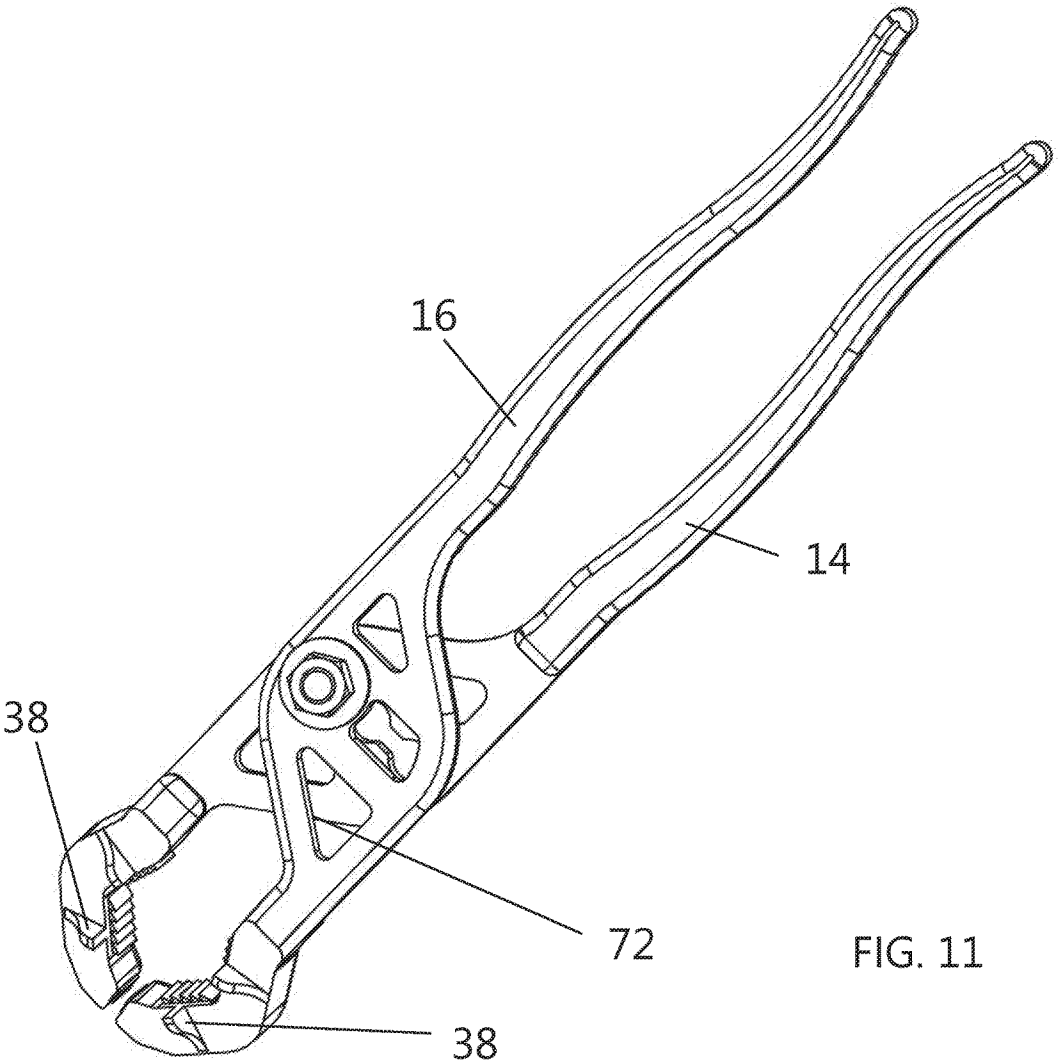
FIG. 11 is a back perspective view of an irrigation wrench in accordance with an embodiment of the invention.
Figure 12:
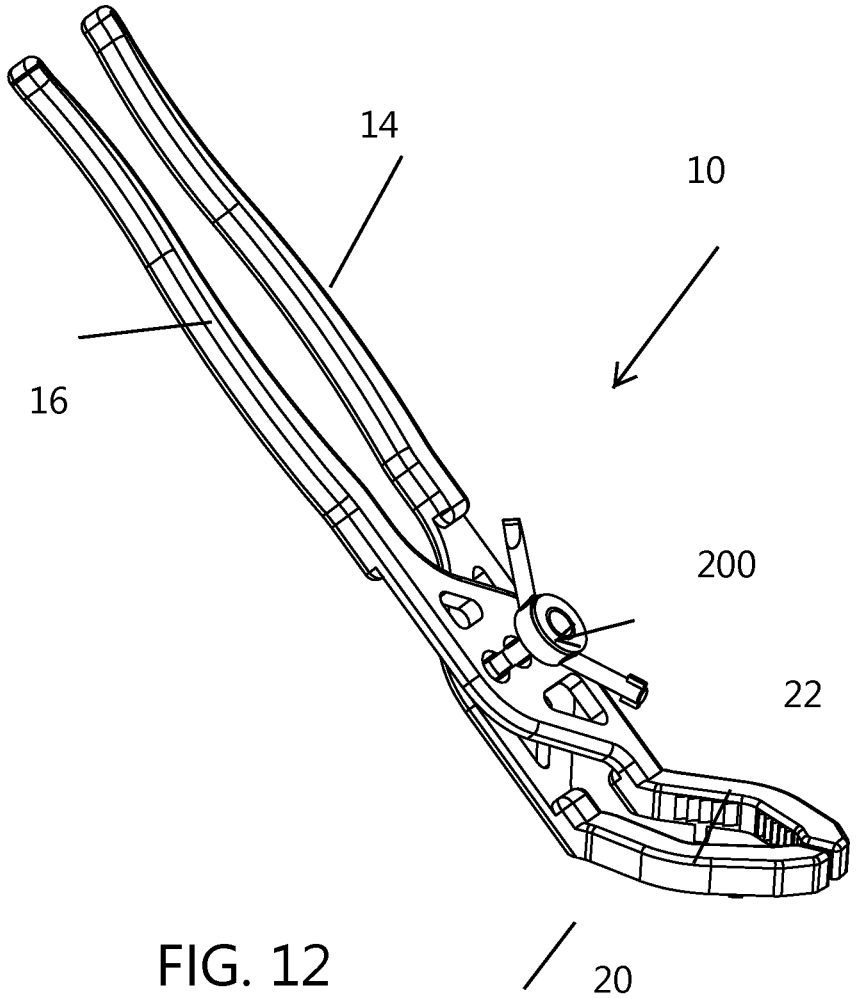
FIG. 12 is a front left perspective view of an irrigation tool in accordance with an embodiment of the invention.
Figure 13:
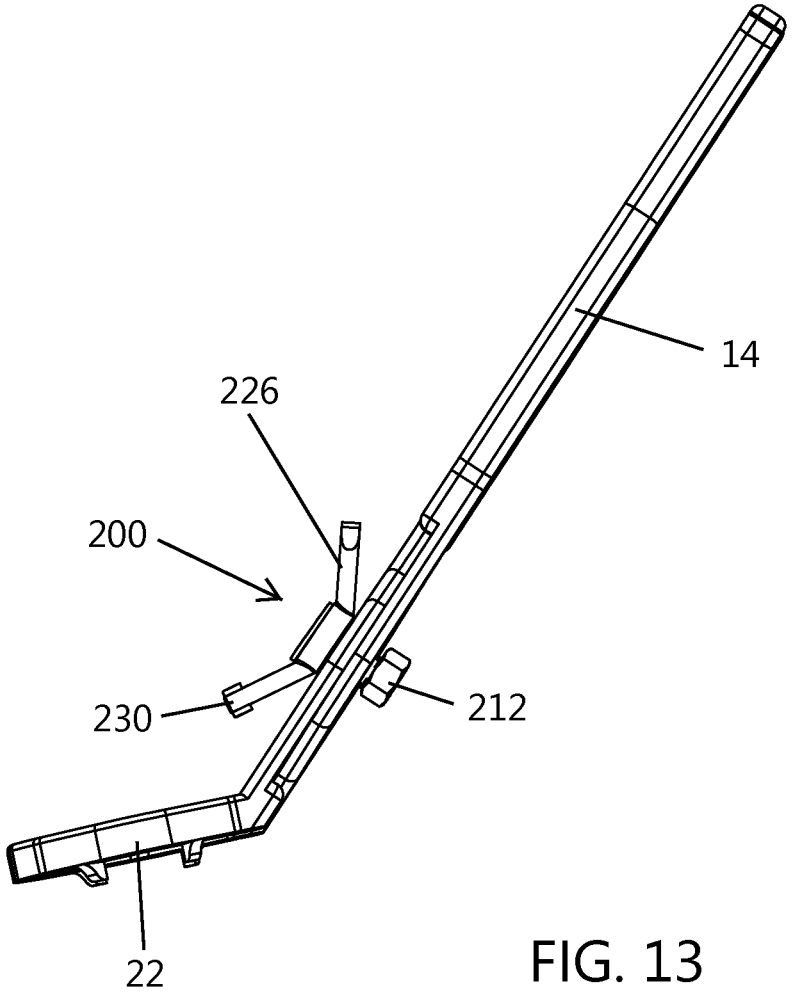
FIG. 13 is a right side perspective view of an irrigation tool of the type shown in FIG. 12.
Figure 14:
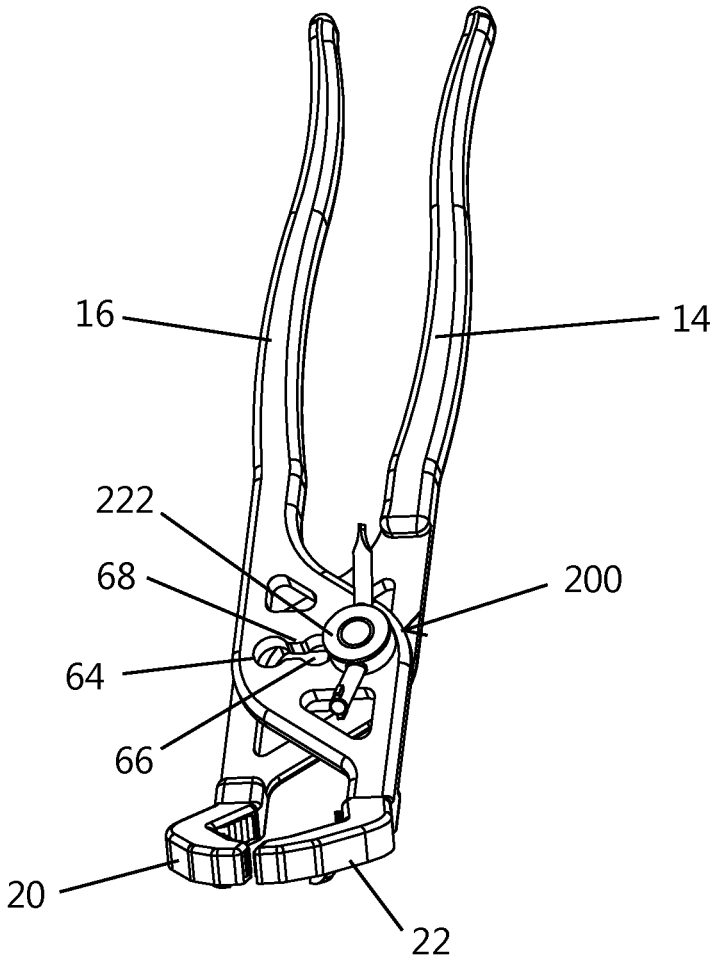
FIG. 14 is a front perspective view of an irrigation tool of the type shown in FIG. 12.
Figure 15:
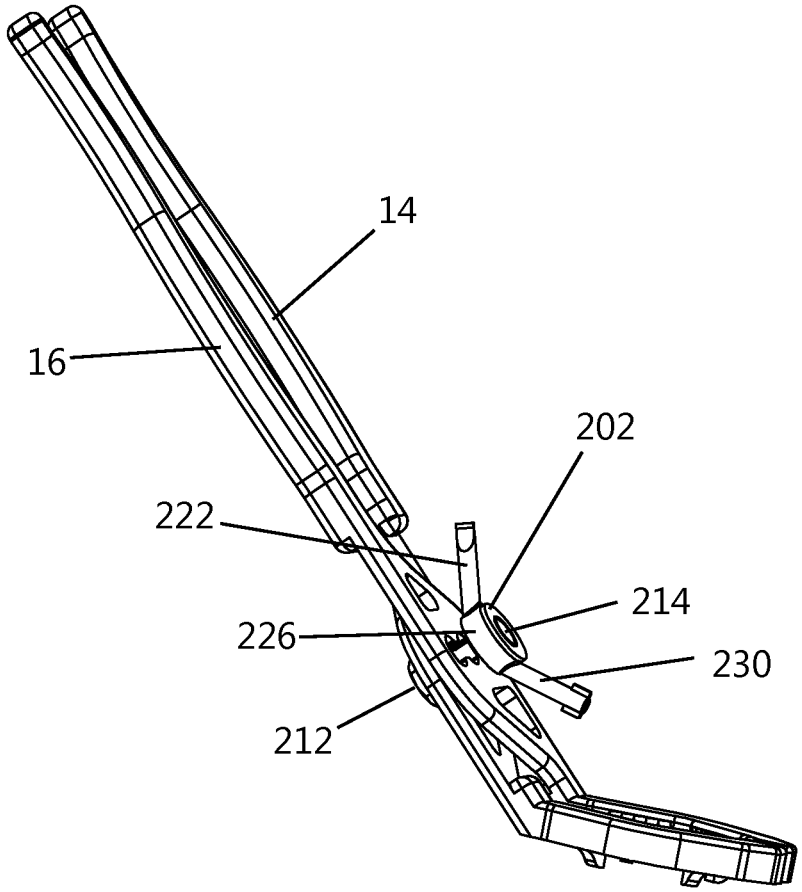
FIG. 15 is a left front perspective view of an irrigation tool of the type shown in FIG. 12.
Figure 16:
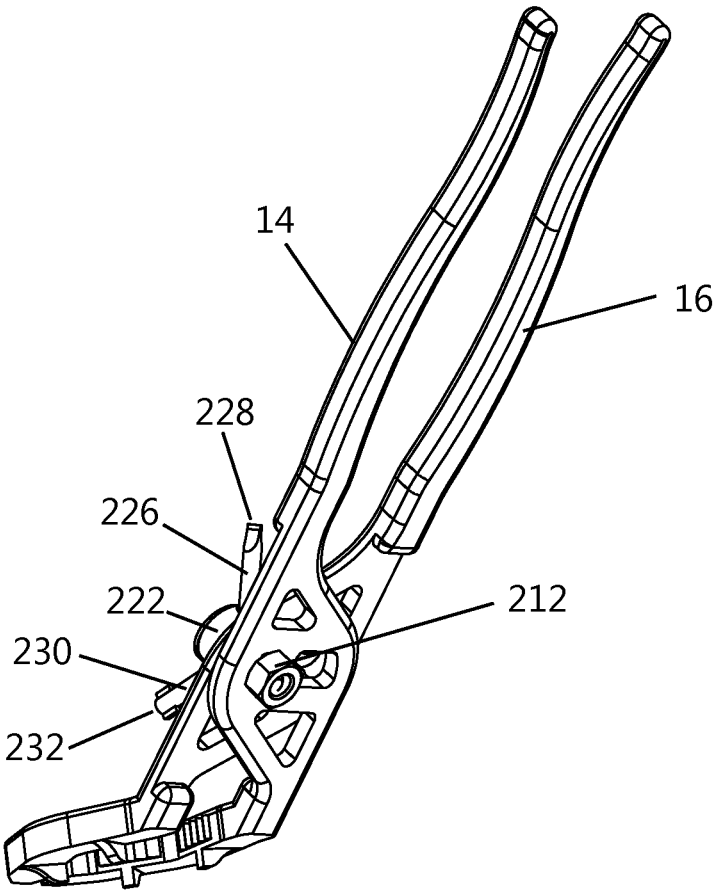
FIG. 16 is a bottom right perspective view of an irrigation tool of the type shown in FIG. 12.
Figure 17:
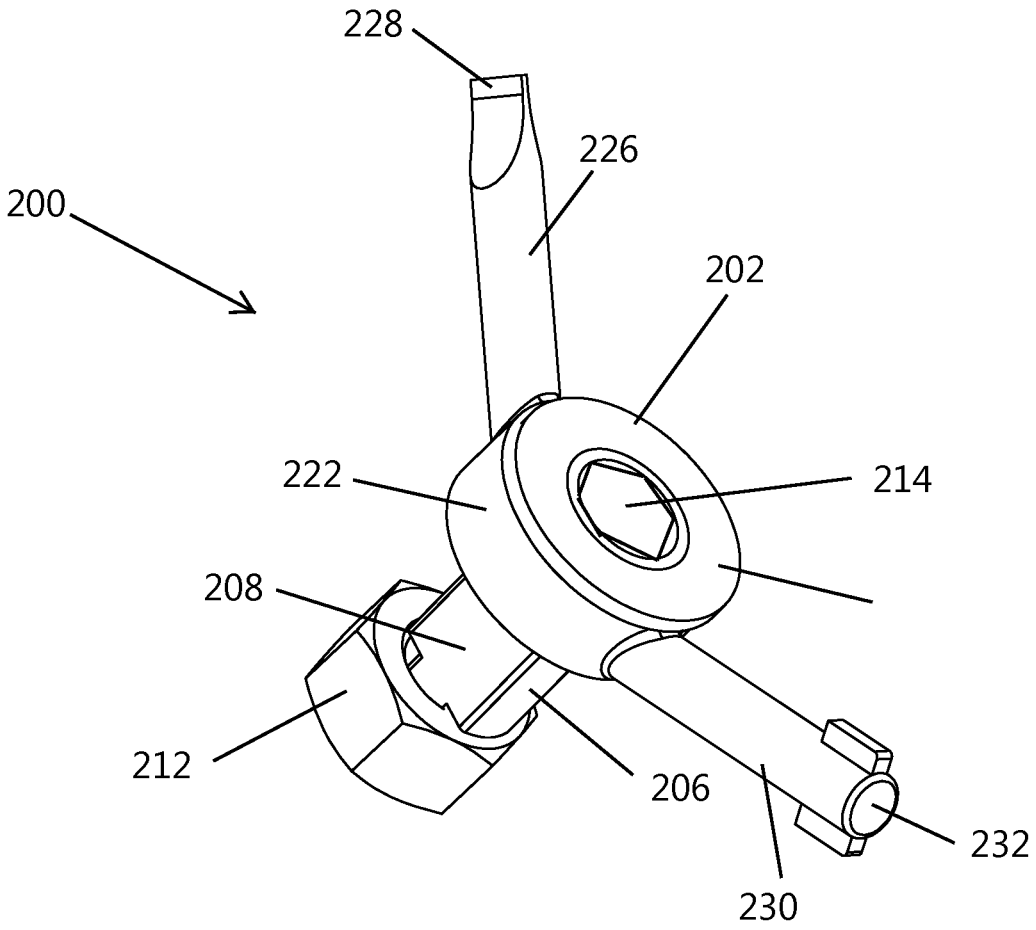
FIG. 17 is a top front right perspective view of a pivot bolt tool in accordance with an embodiment of the invention.
Figure 18:
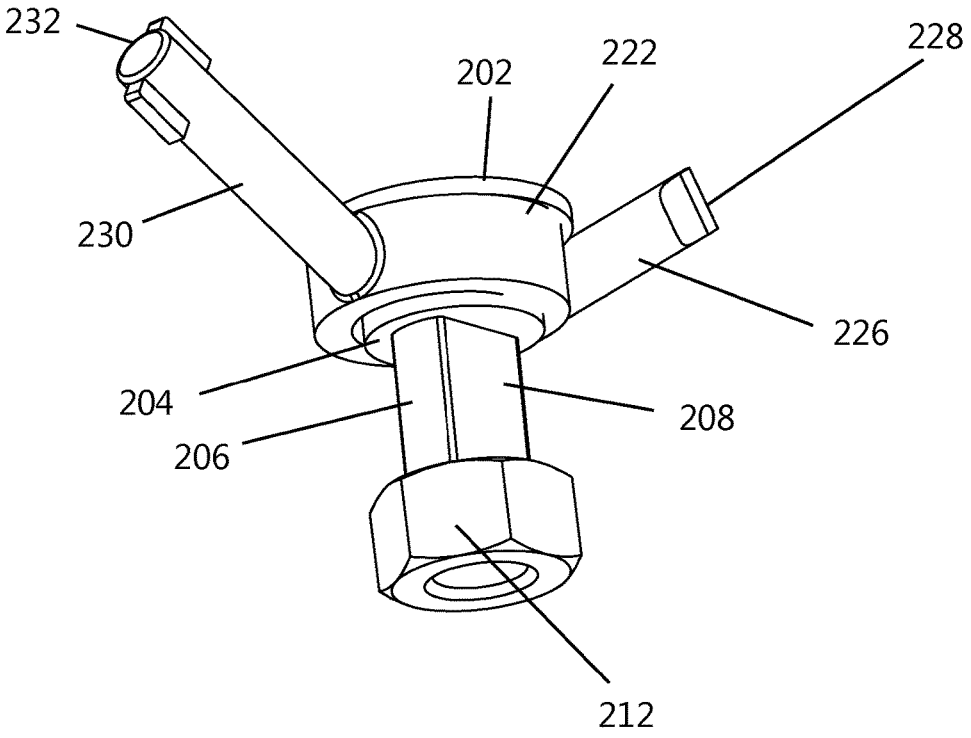
FIG. 18 is a bottom back right perspective view of the pivot bolt tool of the type shown in FIG. 17.
Figure 19:
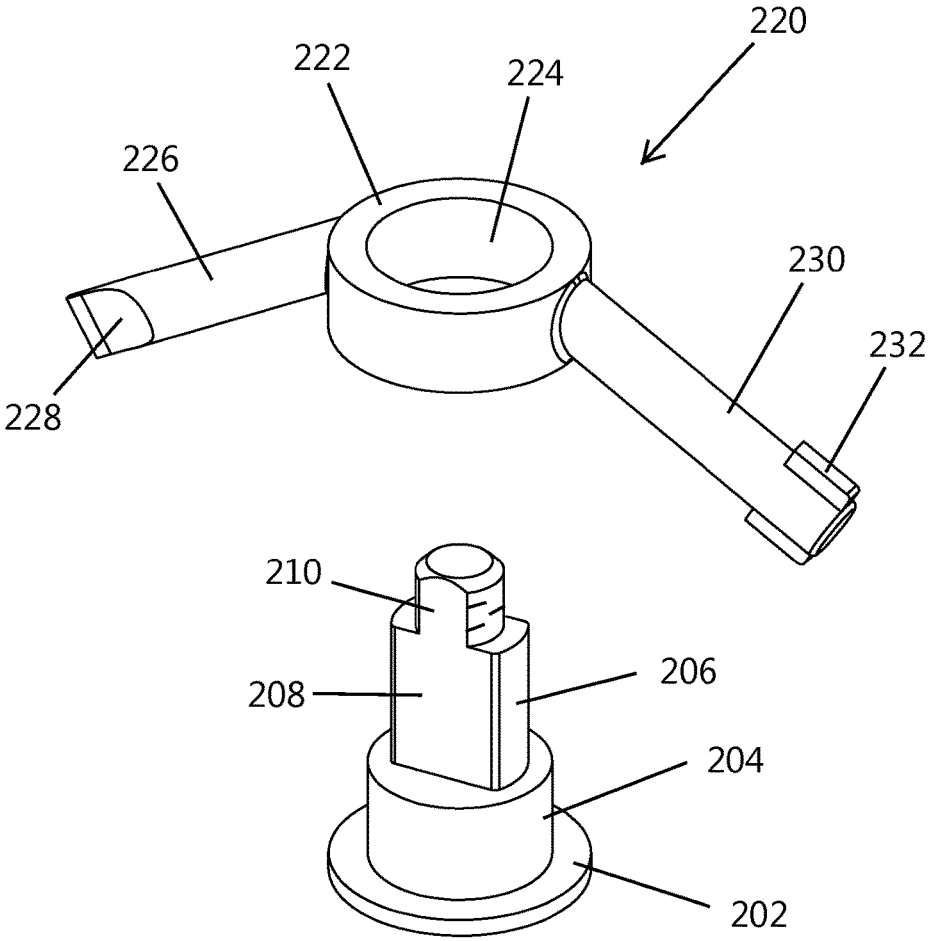
FIG. 19 is an exploded bottom front perspective view of the pivot bolt tool in accordance with an embodiment of the invention and with the nut removed.
Figure 20:
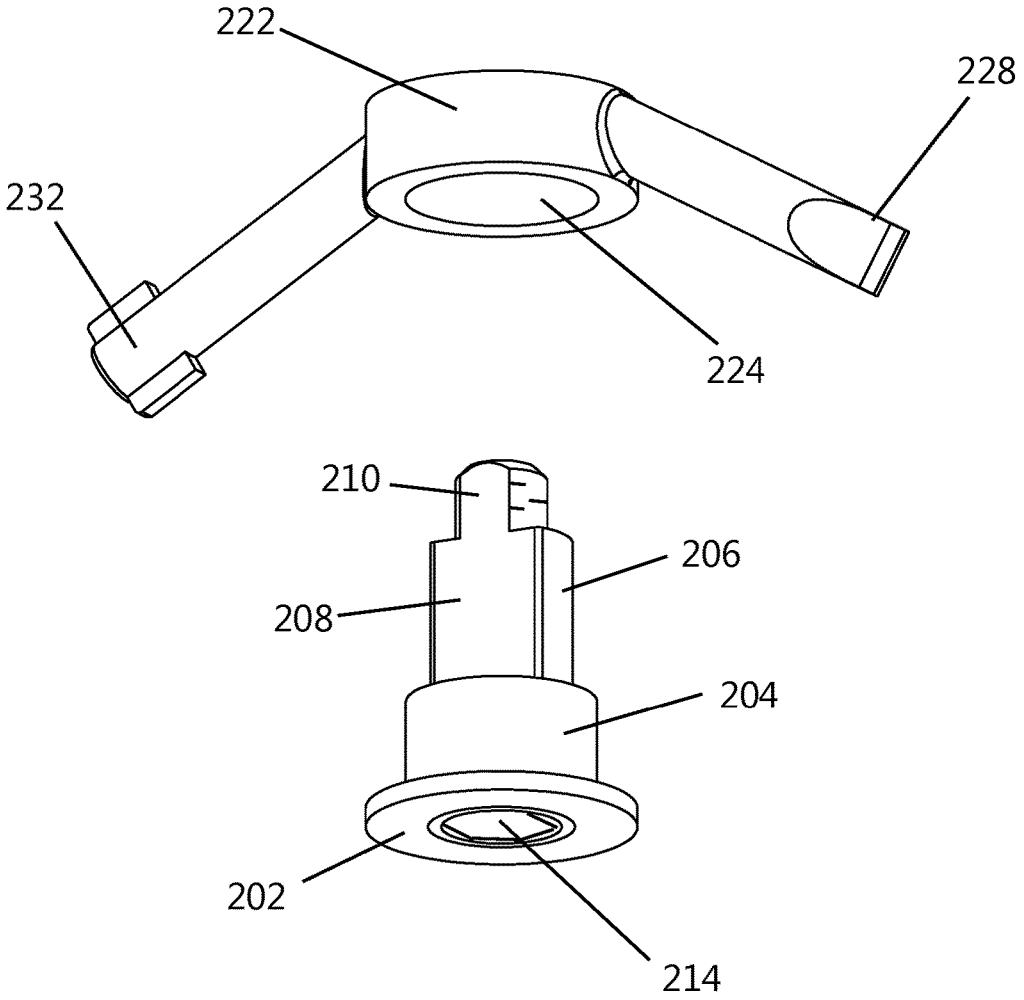
FIG. 20 is an exploded back perspective view of the pivot bolt tool of the type shown in FIG. 17.
Figure 21:
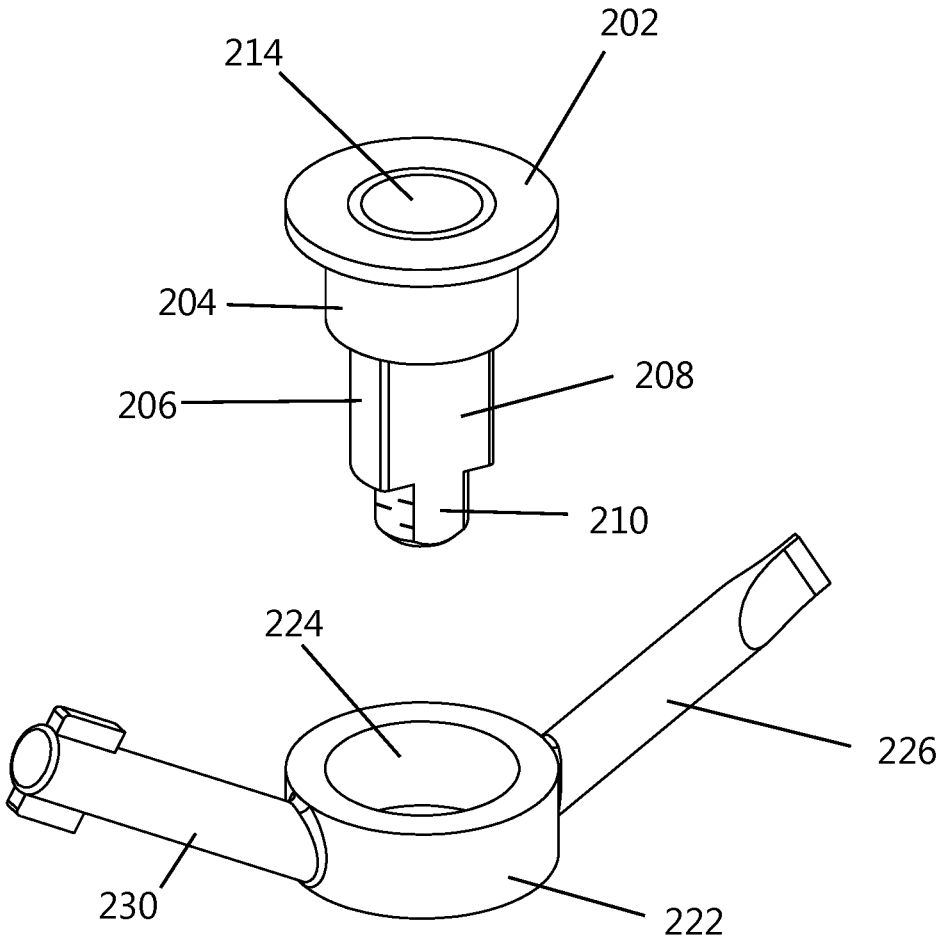
FIG. 21 is an exploded top perspective view of the pivot tool of the type shown in FIG. 19.

FIGS. 10 and 11 illustrate an embodiment of the invention having voids formed in the handles 14 and 16. The voids reduce the amount of required material for the handles and makes for a lighter tool. Lugs 38 extending from the bottom 26 of gripping jaw members 20 and 22 are buttressed to form rigid lugs. Pivot 18 interconnects the handles 14 and 16 in a rotational relation. The pivot includes an adjustable pivot slot 68 that allows the separation distance between the two gripping jaw members to be increased and decreased as desired to best match the diameter of the object to be gripped. The outer tip of each gripping jaw member includes additional teeth that may be used to grip smaller diameter objects.

FIGS. 12-16 illustrates an embodiment of the invention wherein pivot 18 includes a pivot bolt 200. The pivot bolt 200 may be aligned in adjustment holes or cavities 64 and 66. Further, the pivot bolt 200 includes a pivot shoulder 206 that is sized to compliment rotation of the handles while the pivot bolt is positioned within one of the adjustment holes. The pivot shoulder 206 includes flat portions 208 formed on the shoulder 206. The distance between the two flat portions is sized slightly smaller than a width of pivot slot 68. The flat portions 208 may be aligned with the pivot slot 68 such that the pivot bolt 200 may be slid between the adjustment holes 64 and 66 through the adjustable pivot slot 68. Pivot bolt 200 includes a head 202 at one end of the bolt and a threaded tip 210 on an opposing end of the bolt. The head 202 abuts in pivotal relation a top surface of one of the jaw gripping members 20 or 22. Nut 212 is twisted onto the threaded end portion 210 of the bolt and abuts in pivotal relation a bottom surface of one of the jaw gripping members 20 or 22.

FIGS. 17-21 illustrates the pivot bolt 200 removed from the irrigation tool or wrench 10. The pivot bolt 200 includes a head 202 end portion and an opposing threaded end portion 210. A relief shoulder 204 is adapted for retaining tool 220. Pivot shoulder 206 extends between the relief shoulder 204 and threaded end portion 210. Head 202 may include a recess 214 shaped or configured to mate with an allen wrench or other shaped tool that may be utilized to restrain the bolt 200 from rotating. Tool 220 includes collar 222 having a center bore or aperture 224 in which the relief shoulder 204 of bolt 200 rotates. When the pivot bolt is mounted to wrench 10 the bolt 200 remains relatively fixed in place and the tool 220 rotates about bolt 200. The bore 224 inner diameter is sized slightly larger than the outer diameter of the relief shoulder 204 of bolt 200 to allow a smooth rotation of the tool 220 about the bolt 200. In the manner the orientation of the extended tool member 226 and extended tool member 230 relative to the wrench may be altered to a preferred orientation.

These and various other aspects and features of the invention are described with the intent to be illustrative, and not restrictive. This invention has been described herein with detail in order to comply with the patent statutes and to provide those skilled in the art with information needed to apply the novel principles and to construct and use such specialized components as are required. It is to be understood, however, that the invention can be carried out by specifically different constructions, and that various modifications, both as to the construction and operating procedures, can be accomplished without departing from the scope of the invention. Further, in the appended claims, the transitional terms comprising and including are used in the open ended sense in that elements in addition to those enumerated may also be present. Other examples will be apparent to those of skill in the art upon reviewing this document.

What is claimed is:

1. An irrigation tool comprising:

first and second opposed handles;

first and second opposed gripping jaw members extending from corresponding first and second handles, said gripping jaw members having a longitudinal axis that intersects a longitudinal axis of said opposed handles at an angle, each said gripping jaw member having a top and bottom wherein an obtuse angle less than 180 degrees is between the longitudinal axis of said gripping jaw members and the longitudinal axis of said opposed handles measured from a top of the gripping jaw members and a corresponding top of said handles;

a pivot interconnecting the opposing handles allowing rotation of at least one of the first and second handles about said pivot;

a first tool member extending from said pivot, said first tool member having a flattened tip portion; and a second tool member extending from said pivot, said second tool member having a keyed tip portion.

2. The apparatus as recited in claim 1, wherein the longitudinal axis of said gripping jaw member is neither collinear nor coplanar with the longitudinal axis of said corresponding handle.

3. The apparatus as recited in claim 1, wherein said pivot includes at least two pivot points on which the pivot may be formed.

4. The apparatus as recited in claim 1, wherein a separation distance between said first and second opposed gripping jaw members approximates a diameter of an object to be rotated.

5. The apparatus as recited in claim 1, further including at least two spaced apart lugs extending from a bottom of each said first and second gripping jaw members.

6. The apparatus as recited in claim 1, wherein said first tool member extends from said pivot in a direction approximately opposite said second tool member.

7. An irrigation tool comprising:

a first handle having a first gripping jaw member forming a first end of the first handle;

a second handle having a second gripping jaw member forming a first end of the second handle;

a pivot interconnecting the first handle and second handle, wherein said first gripping jaw member is aligned in an opposing relation to said second gripping jaw member, wherein rotation of at least one of the first and second handles about said pivot increases or decreases a separation distance between said first and second gripping jaw members;

a first tool member extending from said pivot, said first tool member having a flattened tip portion;

a second tool member extending from said pivot, said second tool member having a keyed tip portion; and said first and second opposed gripping jaw members together having a gripping jaw longitudinal axis and a portion of said first and second handles adjacent said first and second gripping jaw members together have a handle longitudinal axis, wherein the gripping jaw longitudinal axis intersects the handle longitudinal axis forming an obtuse angle of more than 90 degrees and less than 180 degrees.

8. The apparatus as recited in claim 7, further including lugs extending outward from the bottom of each said first and second opposed gripping jaw members.

9. The apparatus as recited in claim 7, wherein the gripping jaw longitudinal axis is not coplanar with at least a portion of the first and second handle.

10. The apparatus as recited in claim 7, wherein the first and second handles include end portions that angle away from the handle longitudinal axis.

11. The apparatus as recited in claim 10, further wherein at least two spaced apart lugs extend from the bottom of each gripping jaw member.

12. The apparatus as recited in claim 7, wherein said pivot includes at least two pivot points on which the pivot may be formed.

13. The apparatus as recited in claim 7, wherein a separation distance between said gripping jaw members approximates a diameter of an object to be rotated.

14. An irrigation tool comprising:

a first handle having a first gripping jaw member forming a first end of the first handle;

a second handle having a second gripping jaw member forming a first end of the second handle;

a pivot interconnecting the first handle and second handle, wherein said first gripping jaw member is aligned in an opposing relation to said second gripping jaw member, wherein rotation of at least one of the first and second handles about said pivot increases or decreases a separation distance between said first and second gripping jaw members;

a first tool member extending from said pivot, said first tool member having a flattened tip portion; and a second tool member extending from said pivot, said second tool member having a keyed tip portion; and said first and second opposed gripping jaw members together having a gripping jaw longitudinal axis and a portion of said first and second handles adjacent said first and second gripping jaw members together have a handle longitudinal axis, wherein the gripping jaw longitudinal axis intersects the handle longitudinal axis forming an obtuse angle of more than 90 degrees and less than 180 degrees; and lugs extending outward from the bottom of each said first and second opposed grip members.

15. The apparatus as recited in claim 14, wherein the gripping jaw longitudinal axis is not coplanar with at least a portion of the first and second handle.

16. The apparatus as recited in claim 14, wherein the first and second handles include end portions that angle away from the handle longitudinal axis.

17. The apparatus as recited in claim 14, wherein said pivot includes at least two pivot points on which the pivot may be formed.

18. The apparatus as recited in claim 14, wherein a separation distance between said gripping jaw members approximates a diameter of an object to be rotated.

19. The apparatus as recited in claim 14, wherein at least two spaced apart lugs extend from the bottom of each gripping jaw member.

* * * * *